US005152431A

United States Patent [19]

Gardner et al.

[11] Patent Number: 5,152,431

[45] Date of Patent: Oct. 6, 1992

[54] PUMP APPARATUS FOR DISPENSING A SELECTED ONE OF A PLURALITY OF LIQUIDS

[75] Inventors: Beth T. Gardner, Mahwha; Alan N. Bodker, Wayne, both of N.J.

[73] Assignee: Sterling Drug, Inc., Rochester, N.Y.

[21] Appl. No.: 718,880

[22] Filed: Jun. 21, 1991

[51] Int. Cl.[5] ..... B67D 5/60

[52] U.S. Cl. ..... 222/136; 222/144.5; 222/383

[58] Field of Search ..... 222/129, 135, 136, 144.5, 222/209, 401, 383

[56] References Cited

U.S. PATENT DOCUMENTS

| | | | |
|---|---|---|---|
| 1,772,425 | 8/1930 | Lebecque et al. | 222/401 |
| 1,964,362 | 6/1934 | Nassif | 222/136 |
| 2,581,713 | 1/1952 | Roubicek | 222/144.5 |
| 3,211,343 | 10/1965 | Silver . | |
| 3,269,605 | 8/1966 | Silver . | |
| 3,272,387 | 9/1966 | Katz et al. . | |
| 3,366,279 | 1/1968 | Parker, Jr. et al. . | |
| 3,596,802 | 8/1971 | Feldman | 222/144.5 X |
| 3,760,986 | 9/1973 | Castner et al. | 222/137 |
| 3,876,112 | 4/1975 | Kramer . | |
| 4,006,841 | 2/1977 | Alticosalian | 222/144.5 X |
| 4,238,054 | 12/1980 | Chen | 222/136 X |
| 4,355,739 | 10/1982 | Vierkötter | 222/144.5 X |
| 4,549,674 | 10/1985 | Alticosalian | 222/144.5 X |
| 4,622,889 | 11/1986 | Chappell et al. | 222/209 X |
| 4,826,048 | 5/1989 | Skorka et al. . | |
| 4,993,594 | 2/1991 | Becker et al. | 222/136 X |
| 5,009,342 | 4/1991 | Lawrence et al. | 222/136 |

FOREIGN PATENT DOCUMENTS

| | | | |
|---|---|---|---|
| 964242 | 3/1975 | Canada | 222/144.5 |

*Primary Examiner*—Kevin P. Shaver
*Attorney, Agent, or Firm*—Millen, White & Zelano

[57] ABSTRACT

A single pump assembly is used to dispense liquid from a selected one of a plurality of compartments in a container vessel. The pump assembly is detachably mounted on the container vessel and rotates with respect to the container vessel to select the liquid to be pumped.

10 Claims, 2 Drawing Sheets

PUMP APPARATUS FOR DISPENSING A SELECTED ONE OF A PLURALITY OF LIQUIDS

FIELD OF THE INVENTION

The instant invention relates to pump apparatus for dispensing one of a plurality of separate liquids and more particularly the instant invention relates to a pump apparatus for dispensing such liquids from a single container.

BACKGROUND OF THE INVENTION

There are a number of different cleaning products for household and commercial use, which products are used in conjunction with one another. For example, in cleaning a bathroom, one may use a toilet bowl cleaner, a glass cleaner, a disinfectant and perhaps a mold and mildew cleaner. Each of these products is packaged in its own bottle and one ends up carrying a number of separate bottles from room to room. Moreover, a number of bottles must be stored as opposed to a single bottle or container. Anything which makes household chores easier and quicker is usually welcomed by consumers.

A solution to this problem is suggested in the patent literature wherein a plurality of containers connected together or a compartmented container is used instead of separate containers. U.S. Pat. Nos. 3,211,343; 3,269,605; 3,272,387; 3,366,279 and 3,596,802 each utilize valves disposed between a pressurized liquid and a nozzle wherein, when the valves are opened, the pressurized liquids escape. In order to pressurize the liquids in these containers, chlorofluorocarbons (CFCs) are utilized. Since chlorofluorocarbons are considered an environmental hazard, they are being phased out. U.S. Pat. Nos. 3,876,112 and 4,826,048 each teach a separate dispensing means for each liquid instead of utilizing a single pump which is a somewhat inconvenient arrangement. U.S. Pat. No. 4,355,739 discloses utilizing a single pump but the single pump dispenses either a single liquid or a mixed liquid instead of selectively dispensing one of a number of single liquids.

In view of the aforementioned considerations, there is a need for a multiliquid dispensing system for dispensing liquids one at a time, unmixed, from a single container, or perhaps multiple containers nested in proximity to one another.

SUMMARY OF THE INVENTION

It is an object of the instant invention to provide a new and improved arrangement for selectively dispensing one of a plurality of liquids from adjacent compartments through a single pump.

Upon further study of the specification and appended claims, further objects and advantages of this invention will become apparent to those skilled in the art.

In view of this object and other objects, the instant invention contemplates a pump assembly for dispensing liquid from a selected one of several juxtaposed compartments wherein the pump assembly comprises a pump housing including therein a pump mechanism and having thereon a nozzle for dispensing liquid therethrough. The pump housing includes tube means therein connected to the pump. A plurality of dip tubes extend into the separate compartments from a base member having a plurality of openings aligned with the dip tubes. The pump is secured to the base member with tube member aligned with a selected one of the holes in the base member. The tube is mounted so that it may be indexed to a selected hole in the base member wherein the pump can dispense the liquid from a selected compartment.

In accordance with the preferred embodiment of the invention, the compartments are formed in a single container having a threaded neck onto which the pump is threadably mounted.

The instant invention further contemplates a single pump assembly in combination with a multicompartmented container wherein the single pump assembly dispenses the contents of a selected one of the compartments.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
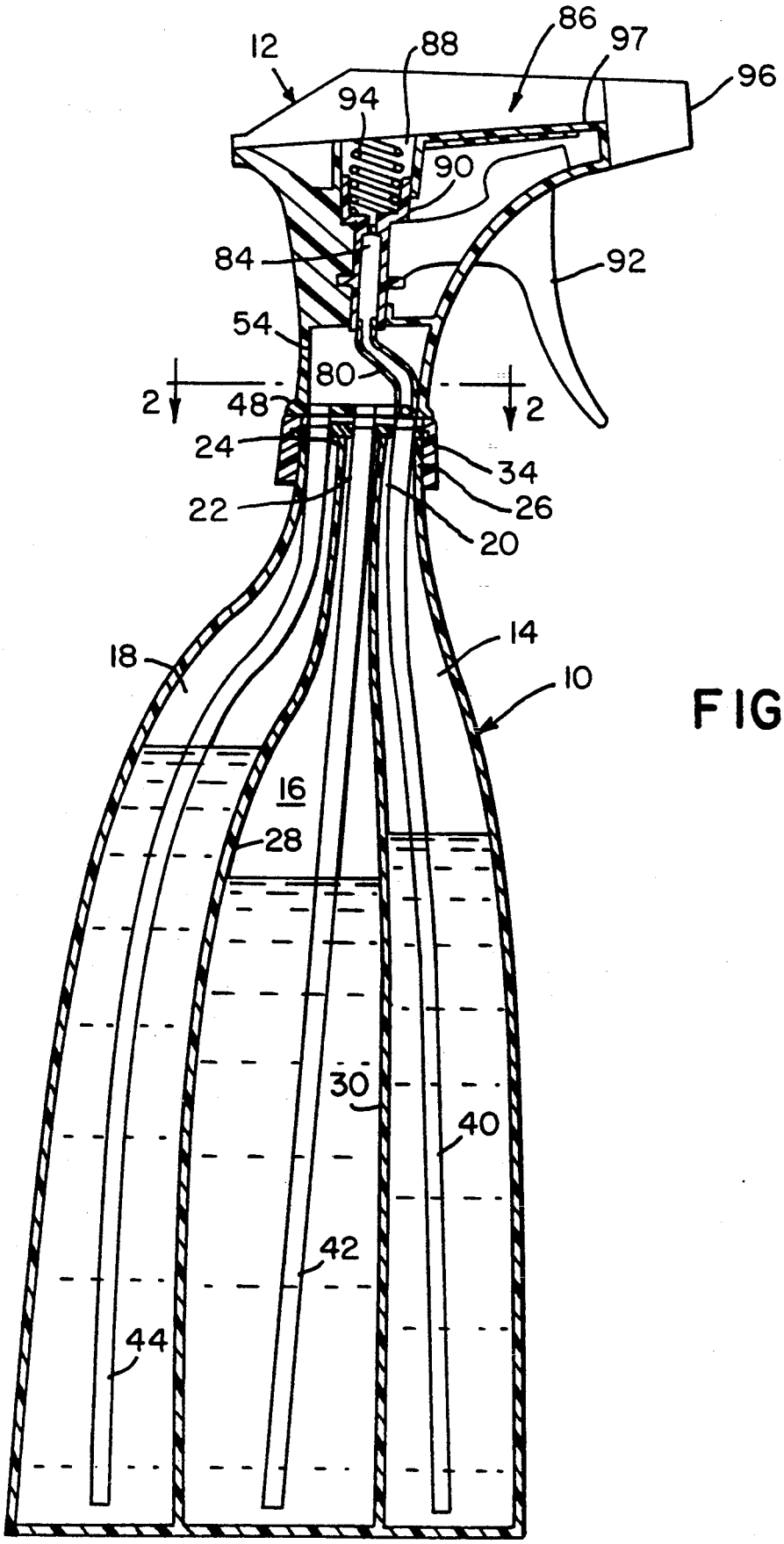
FIG. 1 is a side elevation showing the pump assembly of the instant invention in combination with a compartmented container.
Figure 2:
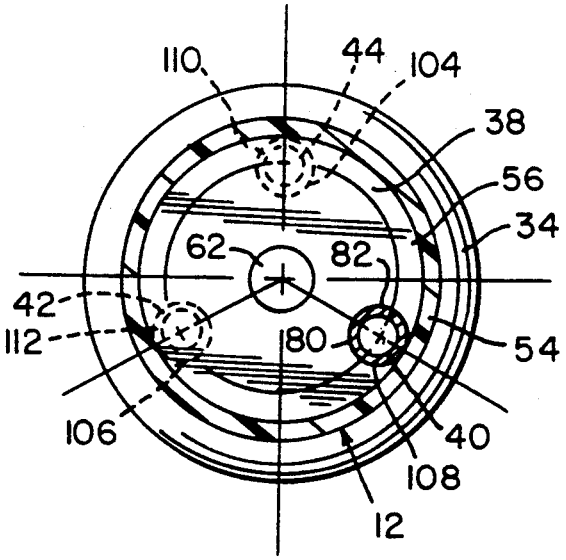
FIG. 2 is an enlarged section taken along lines 2—2 of FIG. 1.

Referring now to FIG. 1, there is shown compartmented container designated generally by the number 10, upon which is mounted a pump assembly configured in accordance with the instant invention and designated generally by the numeral 12. In the illustrated embodiment, the compartmented container includes first, second and third compartments 14, 16 and 18, which are nested together and have separate openings 20, 22 and 24 within a round neck 26 of the container. Since there are three compartments 14, 16 and 18, they preferably nest together and are separated by three radial partitions positioned 120° apart. For clarity, only two partitions 28 and 30 are shown.

Figure 3:
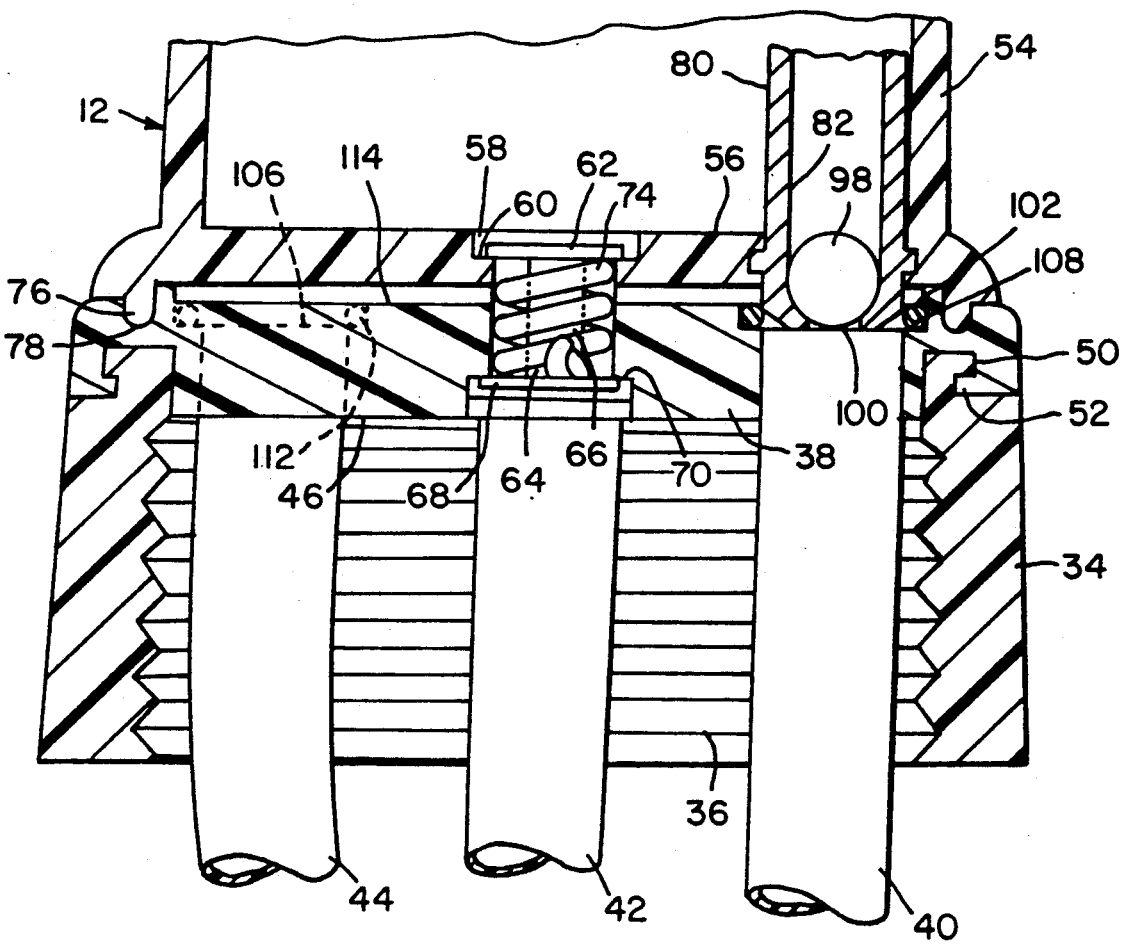
FIG. 3 is an enlarged side elevation illustrating just how a pump is rotatably secured to a collar and base comprising part of the pump assembly.

Referring mainly to FIG. 3, the pump assembly 12 is secured to the neck 26 of the container 10 by a threaded collar 34 which has internal threads 36 which thread with the threads of the neck 26 of container 10. The collar 34 is rotatably mounted on a base 38 to which are secured first, second and third dip tubes 40, 42 and 44. The bottom surface 46 of the base abuts the top 48 of the neck 26 (FIG. 1) when the pump assembly 12 is mounted on the container 10 with the dip tubes 40, 42 and 44 extending into the chambers 14, 16 and 18, respectively. Since the dip tubes 40, 42 and 44 are in the compartments 14, 16 and 18, the base 38 to which they are rigidly affixed cannot rotate when one mounts the pump assembly 12 on the container 10. Accordingly, the collar 34 is mounted on the base 38 to rotate independently thereof by abutting shoulder 50 on the collar 34 with shoulder 52 on the base 38.

The pump assembly 12 includes a pump housing 54 having a bottom 56 unitary or fixed therewith. The bottom 56 has a central opening 58. With an annular shoulder 60 therein which annular shoulder is abutted by a first rivet head 62. The rivet head 62 has a shank 64 thereon which is telescopically mated with a shank 66 fixed to a lower rivet head 68 that abuts an annular shoulder 70 adjacent an opening 72 in the base 38. A coil spring 74 under tension urges the heads 62 and 68 toward one another while allowing the shanks 64 and 66 to telescope so that a swivel is provided whereby the housing 54 of the pump assembly 12 can be rotated with respect to the base 38.

An annular sealing rib 76 projects from the housing 54 into an annular groove 78 formed in the base 38 in order to provide a seal between the housing 54 and base 38.

Within the housing 54 there is disposed an elbow tube 80 which is fixed to project through a single circular opening 82 in the base 38. As is seen in FIG. 1, the elbow tube 80 has its other end fixed in communication with a center tube 84 of a pump designated generally by the numeral 86. The pump 86 may have the configuration of any prior art pump in which liquid is fed thereto through a central inlet tube such as the tube 84. Exemplary of such pumps are the pumps disclosed in patents such as U.S. Pat. No. 3,685,739 or 3,701,478. The tube 84 communicates with a reservoir 88 in the pump 86, which reservoir includes a piston 90 which is reciprocated by a trigger 92 against the bias of a spring 94 to eject the selected liquid through a tube 92 for dispensing through a nozzle 96. It is again emphasized that the structure of the pump 86 may be selected from numerous pump configurations well known to those skilled in the art and disclosed in numerous patents.

As is best seen in FIG. 3, the elbow tube 80 has a check valve in the form of a stainless steel ball 98 which is seated adjacent an opening 100 through the bottom of the elbow tube. When the pump trigger 92 is squeezed, a vacuum occurs in the elbow tube 80 lifting the ball 98 and causing liquid in the dip tube 40 to rise into the elbow tube. As the trigger 92 is repeatedly squeezed, liquid rises from the elbow tube into the central tube 84 of the pump 86 from which it passes into the reservoir 88 to be subsequently dispensed through the nozzle 96 upon subsequently actuating the trigger 92.

If one wishes to select a liquid from a compartment other than the compartment 14, the pump body 12 is lifted against the bias of the spring 74 and rotated with respect to the base 38 and the container 10 which is held in abutment with the base 38 by the threaded collar 34. The end of the dip tube is then registered with the opened top of the dip tube 42 or 44 which has been selected. Adjacent the upper end of each of the dip tubes 40, 42 and 44, are annular recesses 102, 104 and 106 in which are seated O-rings 108, 110 and 112, respectively. As one rotates the pump assembly 12 with respect to the container 10 the end of the elbow tube 80 rides on the top surface 114 of the base 38 and then registers with the openings 102, 104 and 106 by snapping into the openings under the urging of the spring 74. Consequently, an indication is given to the user that the pump housing 12 is properly aligned with one of the dip tubes 40, 42 and 44.

The aforedescribed pump assembly 12 and compartmented container 10 combine as a unit which is convenient and easy to use. The container 10 is also refillable because the pump assembly 12 is readily detachable from the container 10 so that the container may be refilled with liquid from refill packets.

The entire disclosures of all applications, patents and publications, cited above and below, are hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. An arrangement for dispensing liquid from a selected one of a plurality of juxtaposed compartments, the arrangement comprising:

a pump having a housing, a chamber with an inlet and an outlet disposed within said housing, an inlet tube connected to the inlet of the chamber and an outlet nozzle connected to the outlet of the chamber, a piston in the chamber, the piston being biased by a spring to a rest position, a trigger for moving the piston against the bias of the spring to expel liquid in the chamber through the outlet nozzle, the spring returning the piston to the rest position to create a vacuum in the chamber which vacuum draws additional liquid into the chamber through the inlet tube;

a plurality of dip tubes, each dip tube extending into a separate compartment;

a base member having a plurality of openings each connected with a separate one of the dip tubes;

means for securing the pump housing to the base member with the inlet tube aligned with one of the holes in the base member; and means for indexing the inlet tube from alignment with one hole in the base member to alignment with another hole in the base member, wherein the pump selectively dispenses liquid from a selected compartment upon squeezing the trigger.

2. The arrangement of claim 1, wherein the compartments are formed in a single container having a neck and wherein the means for securing includes a collar detachably secured to the neck.

3. The arrangement of claim 2, wherein the collar is threadably secured to the neck and wherein the collar is connected to the base member by means permitting relative rotation of the collar with respect to the base member.

4. The arrangement of claim 3, wherein the housing includes a base plate with a single opening therein and wherein the inlet tube is a single tube in communication with the single opening and the inlet of the pump chamber wherein the single opening in the base plate is selectively alignable with one of the openings in the base member so that the inlet tube communicates with just one of the dip tubes.

5. The arrangement of claim 4, whereing the base member includes an annular recess adjacent each opening therethrough and O-rings seated within the recesses for sealing engagement with the single tube.

6. The arrangement of claim 5, wherein the single tube includes a ball check valve.

7. In combination, a pump assembly and a vessel wherein the container vessel includes a plurality of compartments for containing separate liquids, the combination comprising:

a neck on the container housing with each of the separate compartments of the container housing opening through the neck, the neck including a threaded exterior surface;

the pump assembly including a base plate having openings therethrough and a dip tube extending from each opening for receipt in one of the compartments of the container vessel, a collar rotatably mounted on the base and having internal threads for threadably connecting with the external threads of the neck of the container vessel; the pump assembly further including a pump housing, a pump mechanism within the housing having a single outlet being connected by a single tube to one of the openings in the base plate at a time, the pump housing being rotatably mounted on the base plate for rotation with respect thereto to selectively connect the single tube to one of the openings in the base member.

8. The combination of claim 7, wherein the pump housing assembly includes a bottom portion rotatably connected to the base plate by a swivel which swivel includes a spring for biasing the bottom portion of the housing against the base plate.

9. The combination of claim 8, wherein the base plate includes an annular recess adjacent each opening therethrough and O-rings seated within the recesses for sealing engagement with the single tube.

10. The combination of claim 7, wherein the single tube includes a ball check valve therein.

* * * * *